United States Patent [19]

Schwalley et al.

[11] 4,244,834

[45] Jan. 13, 1981

[54] CARPET CLEANING AND DEODORIZING COMPOSITIONS

[75] Inventors: Lawrence L. Schwalley, Whittier; Richard C. Speak, Fullerton, both of Calif.

[73] Assignee: United States Borax & Chemical Corporation, Los Angeles, Calif.

[21] Appl. No.: 45,729

[22] Filed: Jun. 5, 1979

[51] Int. Cl.[3] ..... C11D 3/04; C11D 3/48

[52] U.S. Cl. ..... 252/106; 252/88; 252/135; 252/140; 252/528

[58] Field of Search ..... 8/137; 252/88, 106, 252/135, 140, 528

[56] References Cited

U.S. PATENT DOCUMENTS

| | | | |
|---|---|---|---|
| 289,621 | 12/1883 | Clarke | 252/139 |
| 302,732 | 7/1884 | Jacobs | 252/135 |
| 879,902 | 2/1908 | Prusz | 252/88 |
| 1,264,104 | 4/1918 | McComb | 252/139 |
| 1,419,625 | 6/1922 | Guernsey | 252/135 |
| 2,165,586 | 7/1939 | Studer et al. | 252/88 |
| 2,213,641 | 9/1940 | Tainton | 252/174.25 |
| 3,044,962 | 7/1962 | Brunt et al. | 252/110 |
| 3,206,408 | 9/1965 | Vitalis et al. | 252/140 |
| 3,632,514 | 1/1972 | Blocher | 252/88 |
| 3,736,259 | 5/1973 | Buck et al. | 252/89 |
| 3,755,180 | 8/1973 | Austin | 252/99 |
| 3,775,052 | 11/1973 | Van Paassen | 8/137 |
| 3,819,517 | 6/1974 | Cavazos et al. | 252/8.1 |
| 3,839,214 | 10/1974 | Schwalley et al. | 252/106 |
| 3,860,525 | 1/1975 | Bechtold | 252/99 |
| 3,862,058 | 1/1975 | Nirschl et al. | 252/528 |
| 4,035,148 | 7/1977 | Metzer et al. | 8/137 |
| 4,062,647 | 12/1977 | Storm | 252/140 X |
| 4,073,996 | 2/1978 | Bedenk et al. | 428/274 |
| 4,126,574 | 11/1978 | Reinwald et al. | 252/179 |
| 4,161,449 | 7/1979 | Smith et al. | 252/8.6 |

FOREIGN PATENT DOCUMENTS

| | | |
|---|---|---|
| 2544605 | 4/1976 | Fed. Rep. of Germany . |
| 2240287 | 4/1975 | France . |
| 1114697 | 5/1968 | United Kingdom . |

*Primary Examiner*—P. E. Willis, Jr.
*Attorney, Agent, or Firm*—James R. Thornton

[57] ABSTRACT

Compositions for cleaning and deodorizing carpets comprising hydrated sodium borate, hydrated metal aluminosilicate and perfume. Cationic quaternary ammonium salts are preferred optional components.

11 Claims, No Drawings

CARPET CLEANING AND DEODORIZING COMPOSITIONS

This invention relates to dry carpet cleaning and deodorizing compositions.

BACKGROUND OF THE INVENTION

Dry carpet cleaning compositions have been known for many years. For example, Studer et al. U.S. Pat. No. 2,165,586 discloses a carpet cleaning composition based on buckwheat flour which is spread over the carpet, worked into the nap, and then removed by use of a vacuum cleaner. Recently, there have been several products available for cleaning and freshening carpets which appear to be based on sodium sulfate and sodium bicarbonate. However, these products exhibit poor flow properties, resulting in difficulty in distributing the composition over the surface of the carpet and removing the composition from the carpet by use of a vacuum cleaner. The compositions provided by the present invention overcome these disadvantages and provide improved cleaning and freshening of household carpets and environs.

DESCRIPTION OF THE PRIOR ART

The prior art discloses numerous sweeping and carpet cleaning compositions, including the Studer et al. patent described above and U.S. Pat. No. 3,632,514. Borates have been suggested as components for sweeping, carpet treating or cleaner compositions. See U.S. Pat. Nos. 302,732, 879,902 and 3,819,517. Borates may also be included as a component of aqueous carpet shampooing compositions, as described in U.S. Pat. No. 3,736,259. U.S. Pat. No. 3,206,408 discloses an aqueous carpet shampooing composition which may contain a finely divided inorganic siliceous clay. Other patents considered in the preparation of this application are U.S. Pat. No. 3,044,962, U.S. Pat. No. 3,860,525, U.S. Pat. No. 3,755,180, U.S. Pat. No. 3,862,058, U.S. Pat. No. 4,062,647, U.S. Pat. No. 4,073,996 and U.S. Pat. No. 4,126,574.

SUMMARY OF THE INVENTION

This invention provides an improved dry carpet cleaning and deodorizing composition which is easily used with an ordinary household vacuum cleaner. The compositions of this invention comprise three essential ingredients, hydrated sodium borate, hydrated metal aluminosilicate and perfume, in specifically defined amounts.

DETAILED DESCRIPTION OF THE INVENTION

The compositions of this invention comprise from about 85 to 99.8% of hydrated sodium borate, from about 0.2 to 15% of metal aluminosilicate and from about 0.01 to 5% of perfume, in which said percentages are by weight. In a preferred composition, the sodium borate comprises about 95–98%, the aluminosilicate is about 1 to 4%, and the perfume represents about 0.5 to 2% by weight of the composition. Preferably, the compositions also contain from about 0.05 to 5% by weight of a cationic quaternary ammonium salt, with about 0.5% to 1% being especially preferred. Other optional ingredients include dyes, such as optical dyes to brighten the carpet, as well as dyes to color the product.

The hydrated sodium borate is preferably a hydrated sodium tetraborate such as sodium tetraborate pentahydrate and sodium tetraborate decahydrate (borax) with the decahydrate being most preferred. The sodium borate preferably has a particle size in the range of from about 30 to 200 mesh, U.S. standard sieve.

The metal aluminosilicates suitable for this invention are the hydrated water-insoluble metal salts such as the sodium, potassium, calcium, and magnesium aluminosilicates. They may be naturally occurring clays or may be the amorphous or crystalline synthetic aluminosilicates such as the zeolites. Particularly suitable metal aluminosilicates are the synthetic molecular sieve zeolites commercially available under trademarks such as Linde ZB-100, ZB-200, ZB-300, Arogen 2000 and Blazer. The metal aluminosilicates are finely divided and preferably have a median particle size in the range of from about 3 to 5 microns.

The perfume component may be any of the commercially available perfume oils, or in the form of spray-dried or encapsulated perfumes, the selection of which will depend on personal preferences among the various fragrances available. The perfume portion may also contain malodor counteractants which are used to mask unpleasant odors.

An optional but preferred ingredient is a cationic quaternary ammonium salt such as the alkyl-substituted quaternary ammonium halides. Such quaternary ammonium salts provide desirable anti-static and, in some cases, biocidal properties to the formulation. Preferred quaternary ammonium salts are the trialkylbenzylammonium chlorides having the formula

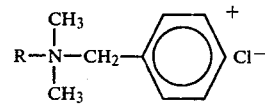

in which R represents $C_{10-18}$ alkyl. A commercially available quaternary ammonium salt is a blend of compounds in which R is $C_{12-16}$ (50% $C_{14}H_{29}$, 40% $C_{12}H_{25}$ and 10% $C_{16}H_{33}$) sold under the trademark CYNCAL by the Hilton-Davis Division of Sterling Drug, Inc. The CYNCAL quaternary ammonium salt is available as an 80% solution in a mixture of ethanol and water for easy handling and formulation. Other suitable quaternary ammonium halides may be used such as mono-, di, and trimethyl long chain alkyl ammonium chlorides in which the long chain groups contain about 8–18 carbon atoms. Examples of such long chain groups include those derived from fatty acids such as the soya, tallow, hydrogenated tallow, palmityl, coco and stearyl radicals. Other quaternary salts such as the complex diquaternaries and imidazolium quaternaries may also be used.

The compositions of this invention are prepared by intimately admixing the various components in a suitable blending apparatus. Preferably, the perfume is in the form of an oil and the cationic quaternary ammonium salt is in solution so that they are readily added to the mixture of sodium borate and aluminosilicate. The oily and liquid components are readily absorbed by the aluminosilicate and borate during such mixing procedures.

The' following examples illustrate representative compositions of the present invention, in which % is by weight.

EXAMPLE 1 sodium aluminosilicate (LINDE ZB 100) 2.0%
borax (sodium tetraborate decahydrate) 96.5%
quaternary ammonium salt (CYNCAL 80%) 0.5%
perfume oil 1.0%

EXAMPLE 2 sodium aluminosilicate 4.0%
borax (sodium tetraborate decahydrate) 95.5%
perfume oil 0.5%

EXAMPLE 3 sodium aluminosilicate (LINDE ZB 200) 4.0%
sodium tetraborate pentahydrate 92.9%
dimethyl alkyl ($C_{10-18}$) benzyl ammonium chloride 1.0%
perfume oil 2.0%
dye 0.02%

In using the compositions of this invention, one merely sprinkles the composition over the surface of the carpet and then removes it by use of a household or commercial vacuum cleaner. The formulations of the invention will absorb greasy soil, moisture and spills and leave the carpet and room smelling fresh and clean. As an added benefit, the compositions deodorize the vacuum cleaner, counteracting undesirable stale odors which can build up in vacuum cleaners. Due to the improved flowability of the formulations of the present invention, they are readily dispensed from any suitable container such as a shaker can, and easily removed from the carpet by use of the vacuum cleaner.

Various changes and modifications of the invention can be made, and, to the extent that such variations incorporate the spirit of this invention, they are intended to be included within the scope of the appended claims.

What is claimed is:

1. A dry carpet cleaning and deodorizing composition comprising about 85 to 99.8% of hydrated sodium borate, about 0.2 to 15% of water-insoluble hydrated metal aluminosilicate and about 0.01 to 5% of perfume, said percentages by weight.

2. A composition according to claim 1 in which about 0.05 to 5% by weight of cationic quaternary ammonium salt is included.

3. A composition according to claim 1 in which said hydrated sodium borate is selected from sodium tetraborate pentahydrate and sodium tetraborate decahydrate.

4. A composition according to claim 1 in which said hydrated metal aluminosilicate is hydrated sodium aluminosilicate.

5. A composition according to claim 1 comprising about 95 to 98% hydrated sodium tetraborate, about 1 to 4% of water-insoluble hydrated sodium aluminosilicate, and about 0.01 to 5% of perfume.

6. A composition according to claim 5 in which about 0.5 to 1% of at least one quaternary ammonium salt of the formula

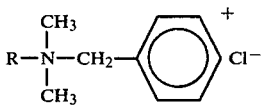

is included, wherein R represents alkyl of about 12 to 16 carbon atoms.

7. A composition according to claim 5 in which said hydrated sodium tetraborate is the decahydrate and has a particle size in the range of from about 30 to 200 mesh.

8. A composition according to claim 5, 6 or 7 in which said sodium aluminosilicate has a median particle size of about 3–5 microns.

9. A composition according to claim 1 in which said aluminosilicate is a synthetic molecular sieve zeolite having a median particle size in the range of from about 3 to 5 microns.

10. A composition according to claim 1 comprising about 95 to 98% sodium tetraborate decahydrate, about 1 to 4% of synthetic molecular sieve zeolite, and about 0.01 to 5% of perfume, said zeolite having a median particle size in the range of from about 3 to 5 microns and said sodium tetraborate decahydrate having a particle size in the range of from about 30 to 200 mesh, U.S. standard sieve.

11. A composition according to claim 10 in which about 0.5 to 1% of at least one quaternary ammonium salt of the formula

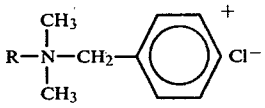

is included, wherein R represents alkyl of about 12 to 16 carbon atoms.

* * * * *